United States Patent [19]

Armstrong

[11] 3,952,890

[45] Apr. 27, 1976

[54] HYDRAULICALLY OPERATED SHOVELS

[75] Inventor: Anthony Clubley Armstrong, Abergavenny, Wales

[73] Assignee: Hy-Mac Limited, Wales

[22] Filed: Mar. 6, 1975

[21] Appl. No.: 556,187

[30] Foreign Application Priority Data

Mar. 12, 1974 United Kingdom ..... 10876/74

[52] U.S. Cl. ..... 214/138 R; 214/775; 214/DIG. 10

[51] Int. Cl.[2] ..... E02F 3/32

[58] Field of Search ..... 214/138, 773, 775, 776, 214/769, 770, 730, DIG. 10

[56] References Cited

UNITED STATES PATENTS

| | | | |
|---|---|---|---|
| 3,522,898 | 8/1970 | Rotheisler | 214/773 |
| 3,570,691 | 3/1971 | Guinot | 214/138 |
| 3,578,188 | 5/1971 | Drieschner | 214/138 |
| 3,606,060 | 9/1971 | Feming et al. | 214/773 |
| 3,792,786 | 2/1974 | Goikhburg et al. | 214/138 |
| 3,862,697 | 1/1975 | Gill et al. | 214/138 |

*Primary Examiner*—Robert J. Spar
*Assistant Examiner*—Ross Weaver
*Attorney, Agent, or Firm*—Brisebois & Kruger

[57] ABSTRACT

A power shovel is described in which the bucket describes a straight line loading movement under power from the luffing rams alone, different straight line movements being obtained by adjustment of the length of the lifting rams which form one side of a deformable quadrilateral. The movements may be level, sloping or vertical. The main arm is shorter than the backet arm so that the loading movements can start close to the chassis of the shovel and the quadrilateral is not deformed into a triangle. A parallelogram linkage for controlling the attitude of the bucket extends from the chassis so that changes in position of the main and bucket arms do not influence the attitude of the bucket.

12 Claims, 2 Drawing Figures

HYDRAULICALLY OPERATED SHOVELS

Figure 1:
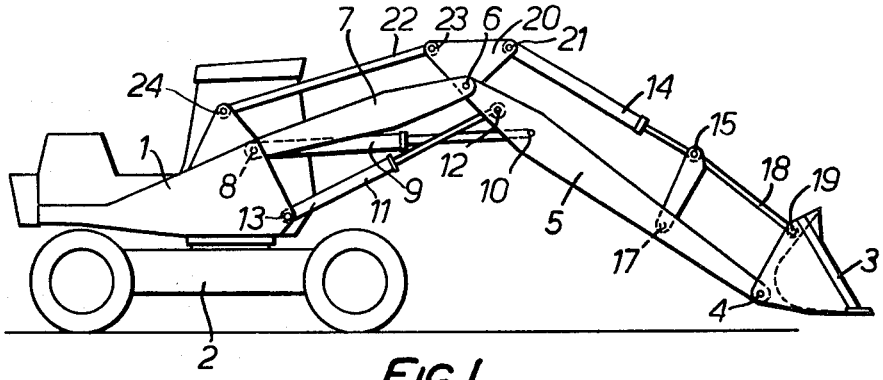

This invention relates to hydraulically operated shovels and has particular but not exclusive reference to such shovels as are mounted on wheeled or crawler track chassis used for scooping up or excavating earth, rocks, coal or other similar bulk materials either in its natural state or already placed in piles by other machines. The shovel is operated by moving an arm system carrying a bucket towards the material to be loaded rather than by moving the entire machine by driving its wheels or tracks towards the material to be loaded.

With hydraulically operated shovels it is frequently required to scoop up material from a flat surface or to cut out the material from a bank so as to form a flat surface on to which the machine can be driven subsequently, for example. The bucket of such a machine is usually mounted on a bucket arm which in turn is pivoted on a main arm pivoted on the chassis of the machine and three sets of hydraulic rams are provided for moving the bucket. One of these sets of rams forms the bucket rams used for controlling the attitude of the bucket relative to the bucket arm. A second set of rams act as lifting rams which are used to lift the bucket by means of the arms to tip the load into a lorry or dump truck, for example. A third set of rams are luffing rams, the function of which is to move the bucket towards and away from the chassis on which it is mounted to effect the required scooping up or excavating action. Because the lifting and luffing rams both move the bucket by acting on the arms on which it is mounted, there is some interaction between the effects of these rams if a level loading action is required of the bucket. Such a level loading action, which is also known as crowd action, usually requires considerable skill on the part of an operator to control the lifting and luffing rams in such a way as to keep the bucket movement level, and not infrequently mistakes are made leading to departures from the desired level loading action and possible damage to the machine or its environment.

In order to overcome this difficulty it has been proposed to provide complex linkages connecting the rams to the arms so as to provide a level loading action, or to use some kind of computer control of the lifting and luffing rams for the same purpose. Both of these arrangements are expensive.

It is an object of the invention to enable a level loading action to be obtained in a simple manner.

According to the present invention there is provided a hydraulically operated shovel having a bucket mounted at one end of a bucket arm, the other end of which is pivotally mounted on a main arm shorter than the bucket arm, the main arm being mounted on a pivot on a chassis member, a luffing ram or rams acting on the bucket arm, and a lifting ram or rams acting between an intermediate point on the bucket arm and a point on the chassis member spaced from the mounting point thereon of the main arm in such a way that the lifting ram or rams cannot lie in the same straight line as the part of the bucket arm between the pivot of the bucket arm on the main arm and the intermediate point, and also that the bucket can be caused to describe a substantially straight line movement in a predetermined direction under the influence of the luffing ram or rams with the lifting ram or rams maintained at a constant length.

The geometry of the main and bucket arms together with the mountings of the lifting ram or rams on the chassis member and the bucket arm may be so arranged that a substantially level movement of the bucket can be obtained for a number of different heights of the bucket by extending or contracting the lifting ram or rams to obtain the desired height and then maintaining the lifting ram or rams at that length whilst the bucket movement is described under the influence of the luffing ram or rams. An alternative geometry can be arranged in which the bucket executes different straight movements which are not parallel to each other, but which radiate from a common point, for example at ground level beneath the chassis member. Straight line movements can also be made in other directions, in particular a vertical loading movement is possible.

A parallelogram linkage, preferably back to the chassis member, may be provided for maintaining constant the attitude of the bucket whilst the articulated arrangement, consisting of the main arm and the bucket arm on which it is mounted is moved. The parallelogram linkage may include a bucket ram or rams for changing the attitude of the bucket without interfering substantially with the attitude control provided by the parallelogram linkage.

The shovel may also include safety means for inhibiting movements under the influence of the rams which could lead to damage of the shovel, its mounting, or other components mounted on the chassis.

In order that the invention may be fully understood and readily carried into effect, it will now be described with reference to the accompanying drawings, of which:-

FIG. 1 is a diagram showing one example of a shovel according to the invention; and FIGS. 2a and 2b are diagrams illustrating the action of the shovel in performing a level loading and discharging actions.

In the following description the references to the hydraulic rams are in the singular for simplicity, but it will be understood that in practice several rams may be acting in parallel for any of the functions.

Referring now to FIG. 1 which shows a hydraulically operated shovel mounted on a turret 1 on a wheeled chassis 2. A bucket 3 is secured by a hinge 4 to one end of bucket arm 5 which itself is pivoted at 6 on an end of a main arm 7 mounted on a pivot 8 on the turret 1. The main arm 7 is shorter than the bucket arm 5 which arrangement has the advantage that with both arms approaching vertical the bucket 3 can be brought in very close to the chassis member 2 without significant departure from the straight line movement. Moreover, because the main arm 7 is also nearly vertical in this position it does not interfere with working close to a wall or cliff for example, as would be the case if the main arm 7 were as long as or longer than the bucket arm 5. A luffing ram 9 extends from the pivot 8 to an attachment 10 at an intermediate point of the bucket arm 5. A lift ram 11 extends between another intermediate point 12 on the bucket arm 5 and a mounting pivot 13 on the turret 1.

The attitude of the bucket 3 is controlled by a bucket ram 14 one end of which is attached to a pivot 15 on a swinging link 16 pivoted at 17 on the bucket arm 5. A rod 18 extends from the pivot 15 to a pivot 19 on the bucket 3. The other end of the bucket ram 14 is pivotally mounted on a triangular member 20 at 21, the member 20 rotating about the pivot 6 on the end of the main arm 7 and having a link 22 coupling it at a pivot 23 to a mounting pivot 24 on the turret 1.

From an examination of FIG. 1, it will be apparent that if the luffing ram 9 is kept at constant length the angle between the main and bucket arms 7 and 5 is kept constant and extension of the lifting ram 11 causes both arms 7 and 5 to rotate about the mounting pivot 8 thereby causing the bucket 3 to be lifted. If the luffing ram 9 is less extended, although the bucket 3 is lifted through a shorter distance for a given angular movement of the arms, because of the shorter effective radius of the pivot 12 about the pivot 8 due to the change in length of the luffing ram 9, the bucket 3 is lifted through only a slightly smaller height for a given extension of the lifting ram 11.

If a level loading action is required, the lifting ram 11 is adjusted to a length which given the required height at the bucket 3 and then the luffing ram is extended. Initially the luffing ram 9 is almost fully retracted so that the angle between the bucket arm 5 and the main arm 7 is small and the bucket 3 is relatively close to the wheels of the machine. As the ram 9 is extended so the quadrilateral formed by the main arm 7, the part of the bucket arm 5 between the pivots 6 and 12, the lifting ram 11 and the part of the turret 1 between the pivots 8 and 13 is deformed so that the bucket 3 moves outwardly from the machine on a substantially horizontal path. The geometry of the main arm 7, the lifting ram 11 and their attachment points to the turret 1 and the bucket arm 5 is so arranged that the deformation of the quadrilateral produces the desired substantially level loading action.

If the lifting ram 11 is extended the height of the bucket 3 is increased and with suitable choice of the geometry described above the bucket will execute a substantially level loading or discharging action at a higher level under the influence of the luffing ram 9 with the lifting ram 11 maintained at an increased constant length. An alternative geometry will result in substantially straight line loading and discharging actions in which the lines approximately radiate from a common point at ground level beneath the chassis 2; this arrangement is of value for levelling an undulating site, for example, or loading from an undulating surface.

The components 14 to 24 constitute a parallelogram linkage for keeping the attitude of the bucket 3 substantially constant whilst the arms 5 and 7 are moved. Because the bucket ram 14 forms part of this parallelogram linkage it follows that the linkage departs from a true parallelogram and the attitude of the bucket 3 is not always kept exactly constant, although it is maintained sufficiently so to ensure consistent performance of the bucket 3 for digging or for holding dug material as the arms 5 and 7 are moved.

If movements other than a level loading action or a simple lifting action are required, then the rams 9 and 11 can be simultaneously operated as in previously proposed hydraulically and mechanically operated shovels to produce the desired movement. As shown in FIG. 1, the turret 1 has a rotatable mounting on the wheeled chassis 2 so as to enable the shovel to operate in any direction relative to the chassis 2.

Although in the example of the invention just described the luffing ram is mounted on the pivot 8 on the turret 1, it will be appreciated that it could be attached to another pivot on the turret or main arm 7. The attachment of the luffing ram 9 elsewhere on turret 1 than at pivot 8 will introduce interaction between the lift and luffing rams, to the extent that arm 5 can be made to rotate about pin 6 on arm 7. Depending on where the luffing ram anchor pivot is placed on the turret, so the bucket 3 can be made to move in or out as it is raised under the influence of the lifting ram 11 with the luffing ram 9 at constant length. This can be used to stop the bucket outreach at ground level at the end of the straight part of its movement and yet still have adequate outreach at discharge height by giving the effect of extending the luffing ram as the bucket is raised, for example. To get this effect, the luffing ram pivot on the turret would have to be positioned above pivot 8. Moreover, the bucket arm 5 is shown as being straight whereas for some constructions of shovels according to the invention it could be an angled or L-shaped member, with the pivots 12 and 10 not on the line joining the end pivots 4 and 6. The use of an angled or L-shaped member for the bucket arm 5 could be advantageous in providing a more uniform force at the bucket 3 than would be obtained with a straight bucket arm when the luffing ram 9 is extended by a constant hydraulic pressure, and could also provide a more convenient location for the pivot 13 than would be obtained with a straight bucket arm. Note that the lifting ram 11 never lies in line with part of the bucket arm between pivots 6 and 12 so that the deformable quadrilateral degenerates into a triangle or re-entrant quadrilateral.

Figure 2:
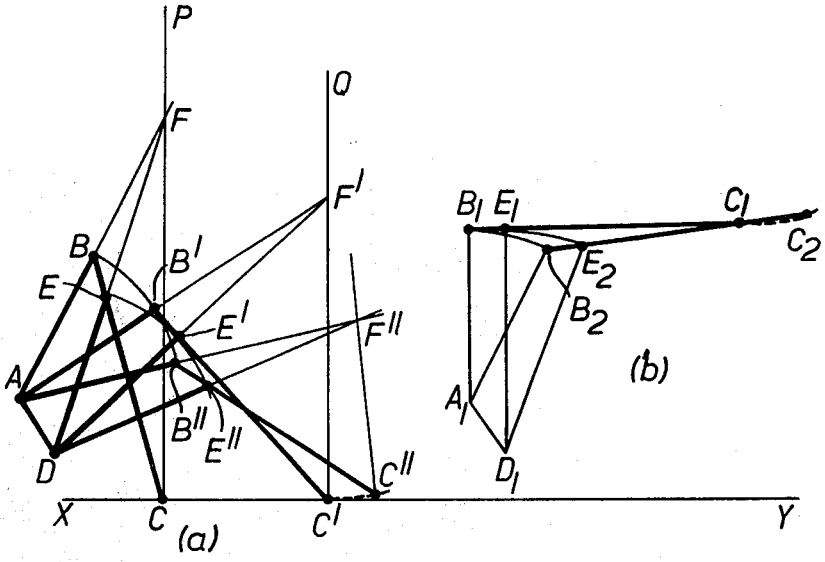

FIG. 2a shows in diagrammatic form the operation of the deformable quadrilateral in producing a substantially level loading action of the bucket 3 (FIG. 1). The four vertices A, B, E and D of the quadrilateral as shown in FIG. 2 correspond respectively to the pivots 8, 6, 12 and 13 of the machine shown in FIG. 1, and the line BEC of FIG. 2 represents the bucket arm 5. The rectangle AB'E'D represents the quadrilateral ABED in a second position in which the point C has moved to C'. To obtain the desired level movement of the bucket, that is to say of the point C along the line XY, it is necessary for the instantaneous centre of rotation of the line BEC to lie on a line perpendicular to the line XY at the point C, that is to say, on the line CP. For this to be so, the lines AB and DE when extended must intersect at a point F on the line CP. It will be apparent that for small movements the point F is the centre of rotation of the line BEC. As the quadrilateral ABED is deformed the point F moves to the right with the point C, although not at exactly the same speed. However, it can be arranged that when the point C is at C' the intersection F' of the lines AB' and DE' lies on the line C'Q perpendicular to the line XY. As before, the point F' becomes the instantaneous centre of rotation of the line B'E'C'.

Although between the points C and C' the instantaneous centre of rotation of the line BEC does not lie on a line perpendicular to the line XY through the point C, the departure is quite small and consequently the departure of the point C from the line XY is negligible. Beyond the point C' the locus of the end C of the line BEC tends to curve upwards away from the line XY as indicated at C'' due to the instantaneous centre F'' lying to the left of the point C'', but this effect in practice tends to counteract the slight forward tipping of the machine as the moment of the weight of the bucket 3 increases or it moves further out.

In order to find the positions for the point E (pivot 12) and point D (pivot 13), given the lengths of the bucket arm 5 and the main arm 7 and the height at which level loading action is required, all that is needed is to draw the lines AB and BC and AB′ and B′C′ for two points C and C′ at which the level loading action is to be accurately obtained. Lines CP and C′Q perpendicular to the line XY representing the level required of the bucket pivot 4 (FIG. 1) are drawn and then the lines AB and AB′ are extended to locate the points F and F′ on the lines CP and CQ. It is now necessary to find the two points E and E′ on the lines BC and B′C′ respectively such that BE is equal in length to B′E′ and such that the angle FEE′ is the same as the angle F′E′E. When E and E′ have been located the lines FE and F′E′ are extrapolated to intersect at D. Thus the four points of the deformable quadrilateral can be determined to provide the level loading action along the line XY.

A substantially level loading or discharging action at a higher level is illustrated in FIG. 2(b) which shows the quadrilateral in two positions, $A_1B_1E_1D_1$ and $A_1B_2E_2D_1$, producing bucket positions $C_1$ and $C_2$ respectively. It will be appreciated that the length of the lines $D_1E_1$ and $D_1E_2$ in FIG. 2b, which respresents the lifting ram 11 of FIG. 1, are longer than the corresponding lines AB, AB′ and AB″ of FIG. 2a because of the higher level of the bucket. When the level loading action is required at more than one height, it is possible to vary the relationship between the lengths of the bucket arm 5 and the main arm 7 to produce an optimum result The above explanation of the manner of obtaining a substantially level loading and discharging action of the bucket at different levels can be extended to apply to angled or L-shaped bucket arms, in which case the straight line BEC of FIG. 2a would be replaced by a suitably angled or L-shaped line. The other lines B′E′C′, B″E″C″, $B_1E_1C_1$ and $B_2E_2C_2$ of FIGS. 2a and 2b would be replaced by lines of the same shape at the line BEC. In determining the relative positions of the point B and E to obtain the required substantially level movement of the point C it is possibly preferable, if the line BEC is angled at E, to extrapolate the line DE to find F and then locate the points B and A using the method described above, rather than follow that method exactly.

Straight line loading and discharging movement can be obtained in other directions, including vertical, if required by suitable change of the direction of the line XY.

Because both the luffing ram 9 and the lifting ram 11 act between the chassis and the bucket arm 5, it is possible for conditions to arise in which the main arm 7 is forced against the chassis structure. If the luffing ram 9 is retracted to its shortest position and the lifting ram 11 is extended, the main arm 7 is rotated in an anticlockwise direction about the pivot 8, and it is clearly necessary to prevent excessive movement in this direction by the main arm 7 to avoid the arm fouling the bodywork of the turret 1. Such additional movement could arise if further retraction of the luffing ram 9 were possible, or the lifting ram 11 were extended. To avoid this difficulty a hydraulic valve, not shown in the drawings, may be provided on or adjacent to the main arm 7 to prevent further retraction of the luffing ram 9 or extension of the lifting ram 11. This valve could, for example, be operated by the coming together of a part of the main arm 7 and an abutment on the structure of the turret 1. Instead of the hydraulic valve co-operating with the movement of the main arm 7, a mechanical connection may be provided for forcing the release of the control valve levers in the cabin to achieve the same result. For safety reasons it is probably advisable to incorporate some resilient component in the mechanical coupling to avoid possible injury to the operator by the forced movement of the control levers. In addition, a strong mechanical stop may be provided in case of failure of the other safety measures or their insufficiently rapid response due to, for example, the inertia of the arms.

Although the invention has been described with reference to an example mounted on a wheeled chassis, it will be appreciated that it is not limited to such a mounting, and it could, for example, be on a crawler-tracked chassis, or even a travelling chassis on a railway or other semi-permanent installation. It will be apparent that the relative dimensions of the two arms and their shapes can be varied, although the mountings of the lifting ram will also have to be changed to obtain the level or other straight line loading action. Moreover, the parallelogram linkage, described for maintaining the attitude of the bucket substantially unchanged as the arms 5 and 7 are moved, can be modified in a variety of ways, or replaced by some other arrangement producing a similar result. In addition, the bucket 3 may be reversed on the arm 5 so that the machine executes an excavating or scooping up operation by drawing the bucket inwardly.

I claim:

1. A hydraulically operated shovel having a bucket mounted at one end of a bucket arm, the other end of which is pivotally mounted on a main arm shorter than the bucket arm, the main arm being mounted on a pivot on a chassis member, a luffing ram or rams acting on the bucket arm, and a lifting ram or rams acting between an intermediate point on the bucket arm and a point on the chassis member spaced from the mounting point thereon of the main arm in such a way that the lifting ram or rams cannot lie in the same straight line as the part of the bucket arm between the pivot of the bucket arm on the main arm and the intermediate point, and also that the bucket can be caused to describe a substantiallyl straight line movement in a predetermined direction under the influence of the luffing ram or rams with the lifting ram or rams maintained at a constant length.

2. A shovel according to claim 1 further including a parallelogram linkage extending over the main arm and the bucket arm from the chassis member to the bucket for keeping the bucket attitude substantially constant despite changes in position of the main arm and bucket arm relative to the chassis member.

3. A shovel according to claim 2, wherein the parallelogram linkage incorporates a bucket ram for adjusting the attitude of the bucket.

4. A shovel according to claim 1 wherein the geometry of the main arm and bucket arm together with the mountings of the lifting ram or rams on the chassis member and the bucket arm are so arranged that the bucket can be caused to describe under the influence of the luffing ram or rams alone different substantially straight line movements with different extensions of the lifting ram or rams.

5. A shovel according to claim 4 wherein when the bucket is at ground level the direction of straight line movement of the bucket is substantially parallel to the line of the ground on which the shovel stands.

6. A shovel according to claim 4 wherein the different substantially straight line movements are substantially parallel to each other.

7. A shovel according to claim 5 wherein the different substantially straight line movements of the bucket approximately radiate from a common point at ground level beneath the chassis member.

8. A shovel according to any of claim 1 wherein the direction of straight line movement of the bucket is substantially horizontal.

9. A shovel according to any of claims 1 wherein the direction of straight line movement of the bucket is substantially vertical.

10. A shovel according to any of claim 4 wherein the movement of the bucket is such that at the most forward extremity of its travel the bucket tends to be raised slightly above the straight line, thereby counteracting a slight forward tipping of the shovel due to the relatively large amount of a loaded bucket at the most forward extremity of its travel.

11. A shovel according to claim 1 wherein the bucket arm is substantially straight and the intermediate point on the bucket arm lies substantially on a straight line joining the pivot of the bucket arm on the main arm and the attachment of the bucket to the bucket arm.

12. A shovel according to claim 1 including safety means for inhibiting movements under the influence of the rams which could lead to damage to parts of the shovel.

* * * * *